US005239142A

United States Patent [19]

Ekholm et al.

[11] Patent Number: 5,239,142

[45] Date of Patent: Aug. 24, 1993

[54] SELECTION OF AN ELEVATOR FOR SERVICE BASED ON PASSENGER LOCATION AND ELEVATOR TRAVEL TIME

[75] Inventors: Ralf Ekholm, Helsinki; Riitta Partanen-Jokela, Hyvinkaa, both of Finland

[73] Assignee: Kone Elevator GmbH, Baar, Switzerland

[21] Appl. No.: 694,971

[22] Filed: May 6, 1991

[30] Foreign Application Priority Data

May 10, 1990 [FI] Finland ..... 902343

[51] Int. Cl.[5] ..... B66B 1/20

[52] U.S. Cl. ..... 187/127; 187/121; 187/132; 187/134

[58] Field of Search ..... 187/127, 121, 124

[56] References Cited

U.S. PATENT DOCUMENTS

| | | | |
|---|---|---|---|
| 3,593,825 | 7/1971 | Gieseler | 187/29 |
| 3,648,805 | 3/1972 | Suozzo et al. | 187/28 |
| 3,844,383 | 10/1974 | Iwasaka et al. | 187/29 |
| 3,857,465 | 12/1974 | Iwasaka et al. | 187/29 |
| 4,007,812 | 2/1977 | Nelson, Jr. | 187/29 |
| 4,064,971 | 11/1977 | Iwasaka et al. | 187/29 |
| 4,244,450 | 1/1981 | Umeda et al. | 187/124 |
| 4,669,579 | 6/1987 | Ookubo | 187/124 |
| 4,672,531 | 6/1987 | Uetani | 364/138 |
| 4,685,538 | 8/1987 | Kamaike | 187/121 |
| 4,735,294 | 4/1988 | Schroder | 187/121 |
| 4,776,432 | 10/1988 | Magee | 187/121 |
| 4,802,557 | 2/1989 | Umeda et al. | 187/127 |
| 4,878,562 | 11/1989 | Schroder | 187/127 |
| 4,991,694 | 2/1991 | Friedli | 187/127 |
| 5,092,431 | 3/1992 | Schroder | 187/127 |

FOREIGN PATENT DOCUMENTS

| | | |
|---|---|---|
| 248997 | 4/1987 | European Pat. Off. . |
| 1144454 | 2/1963 | Fed. Rep. of Germany . |
| 1245558 | 7/1967 | Fed. Rep. of Germany . |
| 2217046A | 10/1989 | United Kingdom . |

OTHER PUBLICATIONS

Patent Abstracts of Japan, vol. 14, No. 212 (M-969) May 1990 and JP-A-2048378 (Hita Chi Elevator Eng & Service Co. Ltd.) Feb. 1990.

*Primary Examiner*—Steven L. Stephan
*Assistant Examiner*—Robert Nappi
*Attorney, Agent, or Firm*—Nixon & Vanderhye

[57] ABSTRACT

A system for selecting an elevator in a group consisting of elevators serving the floors of a building, each floor being provided with call input devices for the input of the passengers' calls, the elevator group having a group control unit controlling the group and provided with at least one computer. On the basis of the call sent by a call input device, the group control unit finds out which call input device has issued the call and selects one of the elevators for serving the floor in question on the basis of the passengers' location on the landing according to the information thus obtained.

19 Claims, 5 Drawing Sheets

SELECTION OF AN ELEVATOR FOR SERVICE BASED ON PASSENGER LOCATION AND ELEVATOR TRAVEL TIME

BACKGROUND OF THE INVENTION

1. Field of the Invention

The present invention relates to a method and apparatus for selection of an elevator in an elevator group.

The elevators in an elevator group should be laid out so that the distances between the elevators be as short as possible to allow the passengers to traverse the distance to that elevator whose door is opened in a short time, thus allowing the doors to be closed as quickly as possible. For architectural reasons, this is not always possible, and the distances between elevators should be increased due to many factors, such as the presence of stairs or equivalent between the elevators.

Moreover, in the case of elevator groups with several elevators placed oppositely, the space between the elevators is often furnished with flowers, chairs, etc. Thus, a passenger waiting for an elevator must get around these obstacles if an elevator on the other side of the lobby arrives first. This must be taken into consideration in the control of the elevator group by using longer door-open times, which leads to a considerable loss of transportation capacity as the doors are often kept open longer than necessary.

An elevator group should be so structured that, dimensioned in accordance with common practice, it would be capable of transporting all the passengers even during busy rush hours without the passengers having to line up at the landings. For many reasons, this is generally not the case in large elevator groups. One of the main reasons is that during peak traffic in large elevator groups a small number of passengers travel in the direction opposite to the prevailing peak traffic direction. These passengers usually travel one by one, and keeping the doors open for an unduly long time for them means a considerable decrease in the transportation capacity at a time when it is desirable to use all the available capacity as efficiently as possible to cope with the peak traffic.

In the case of a large elevator group, which in this context means five or more elevators working under the same group control system and serving the same floors, the elevator lobby should be made large enough to allow the passengers to wait and walk freely, without delays caused by insufficient space. This means that the distances between the outermost elevators should be large. Thus, the time for opening the doors for single passengers during peak traffic must be very carefully optimized, otherwise the transportation capacity will be reduced even more significantly due to the longer door-open times required by the size of the lobby and to the longer door-close times caused by the large size of the doors generally used in large elevator groups.

It is known that, in the determination of the transportation capacity of an elevator group, about one third of the time available to an elevator is dependent on the passengers' walking to the doors and in the door area. Thus, improving the efficiency of door operations has a significant effect on the operation of the elevator group as a whole. Another fact restricting the transportation capacity in the case of large elevator lobbies is that the passengers waiting for an elevator form a disordered, scattered crowd in front of the elevators.

In some previously known procedures, passengers who desire to travel in a direction opposite to the direction of the main traffic during heavy peak hours are not served at all for determined short periods, e.g. five minutes, or the standard of service offered to these passengers is lowered intentionally by employing various control principles, e.g. by allowing only one elevator to serve calls for transport in the opposite direction. In the latest microcomputer-based systems, the priorities of calls for transport in the direction of the peak traffic may be intensified with respect to calls for transport in the opposite direction. In business buildings, this is naturally a hindrance to the activities.

Further inconveniences appear from the fact that some passengers who have to wait longer than the others may become too impatient to wait and they intentionally enter a car travelling in the undesired direction, reckoning that they will get faster to the destination by going first in the opposite direction and then back in the desired direction. This practice places an unnecessary additional load on the transportation capacity of the elevator group.

In some of the current procedures, this problem is taken into consideration in the development of the principles for controlling elevator groups by allowing the group control decide at a very early stage which elevator will serve which floor. On the basis of this decision, the system performs a so-called advance signalling, which in this context means that the passengers are informed in good time which elevator is arriving, by means of signalling devices provided on the floors, e.g. by blinking the appropriate direction arrows at the landings. As the elevator starts decelerating, after the group control system has made the irrevocable decision that the elevator shall stop, a final arrival signal is given e.g. with a continuous light in the direction arrow. In some situations, however, the operation of the system may depart from the advance signalling in as many as over 20% of the cases.

This results in a considerable drawback because departures from the advance signalling cause confusion when the passengers waiting in the lobby after all have to use an elevator other than the one indicated by the advance signalling. A further drawback is that a cancellation after the advance signalling require additional time for the passengers to walk to another elevator after they had already gathered in front of the advance signalled elevator. Thus, the distance to another elevator may be still longer.

To eliminate the reduction in the transportation capacity resulting from long door-open times, a currently used procedure employs a door control system in which the length of the basic door-open time is set to a value depending on the dimensions of the lobby, but when an electric eye placed in the door opening indicates that passengers are entering the car, the door-open time for subsequently entering passengers is shortened considerably. People travelling in a group easily notice each others moves. Those standing close will reach the door soon enough, whereafter even the slow persons have enough time to reach the car although the door times have been adjusted to a low value. This principle works fairly well in up- or down-peak situations in large business buildings, where it does not take long for few passengers to gather in the lobby. However, in the case of single passengers, a considerable loss of time still can not be avoided. In the internal traffic in a building, this procedure does not bring any noticeable advantage.

Furthermore, all the above-mentioned solutions have the common drawback that they are based on the assumption that single passengers follow the advance signalling. However, passengers travelling alone pay particularly little attention to the signalling. Also, old people, invalids and children often do not act according to the assumptions regarding passenger behaviour on which the solutions referred to are based.

SUMMARY OF THE INVENTION

The object of the present invention is to eliminate the drawbacks mentioned above and to obtain a flexible and reliable method for increasing the transportation capacity of an elevator group.

The features characteristic of the procedure of the invention for the selection of an elevator on the basis of a call issued from a landing are presented in the following.

Accordingly, an elevator is selected from a group consisting of a known number of elevators serving a known number of floors of a building, each floor being provided with call input devices communicating the calls, said elevator group having a group control unit controlling the group, provided with at least one computer, wherein the group control unit, based on a call received from a call input device, detects said call input device which communicated said call and selects an elevator to serve a floor in question from which said call has been effected, on the basis of the passengers' location on said floor is provided.

BRIEF DESCRIPTION OF THE DRAWINGS

In the following, the invention is described in detail by the aid of an example with reference to the attached drawings, in which.

DETAILED DESCRIPTION OF THE INVENTION

Figure 1:
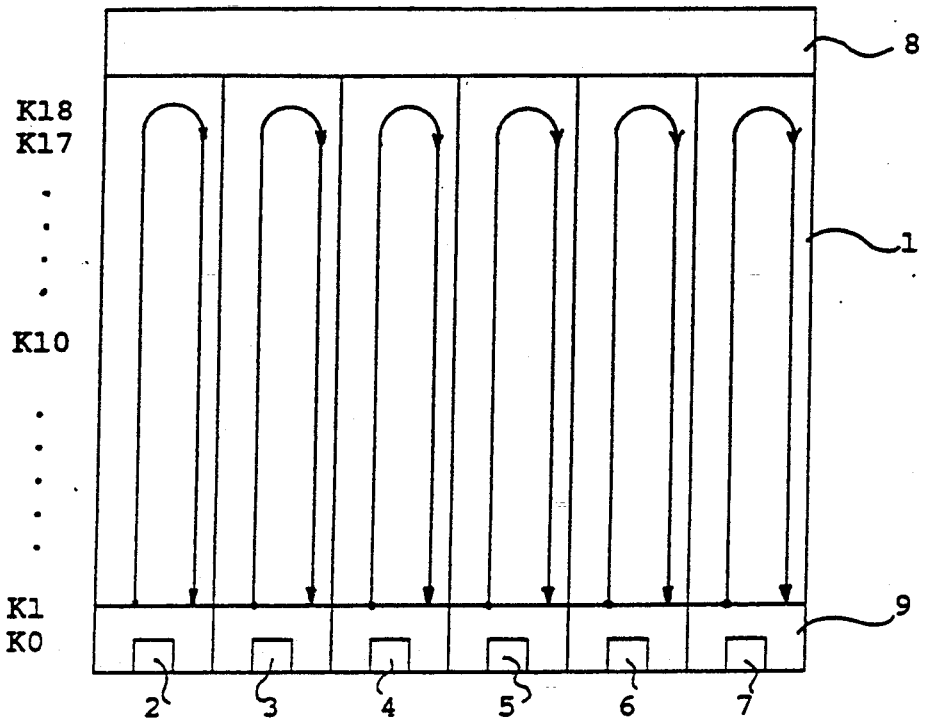
FIGURE 1 (PRIOR ART)
FIG. 1 illustrates a diagram of a large building with a bank of six elevators serving eighteen floors, and a machine room for the control equipment, located at the top.

FIG. 1 illustrates a block diagram representing a large building 1 with six elevators 2, 3, 4, 5, 6 and 7 connected together as a group serving the entrance floor K0 and eighteen floors K1–K18. The machine room 8 for elevators and the elevator lobby 9 on the entrance floor are also shown on FIG. 1.

Figure 2:
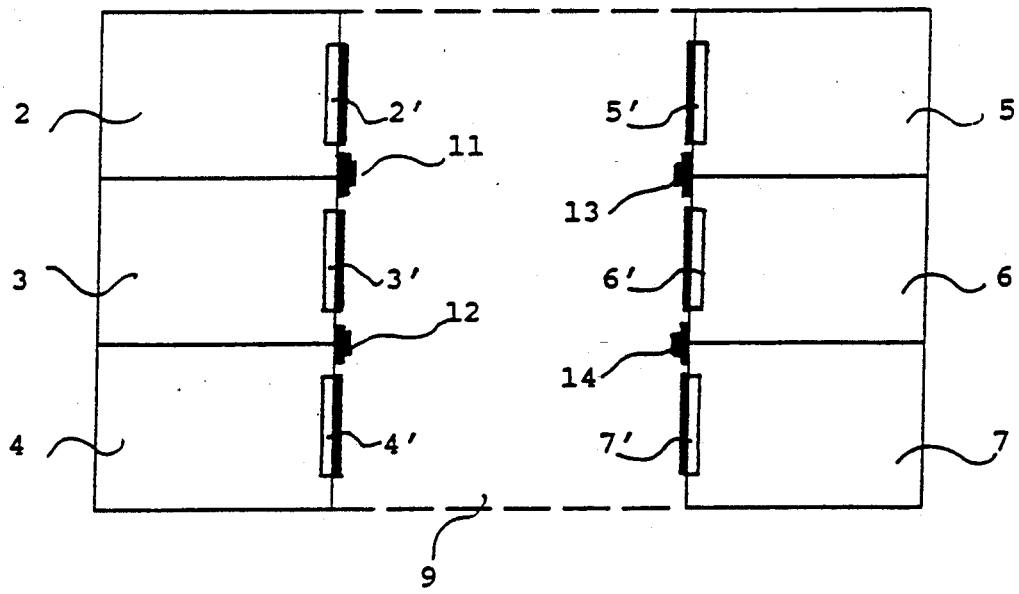
FIGURE 2 (PRIOR ART)
FIG. 2 illustrates the lay-out for an elevator lobby on the entrance floor according to the commonest rule for a group of six elevators, i.e. three and three placed oppositely.

FIG. 2 shows the entrance floor lobby 9 in the case of a six-elevator group laid out according to the most used rule: three and three placed oppositely. The devices for registering landing calls are placed by doors 2'–7' as follows: devices 11 and 12 on one side, devices 13 and 14 on the other side.

Figure 3:
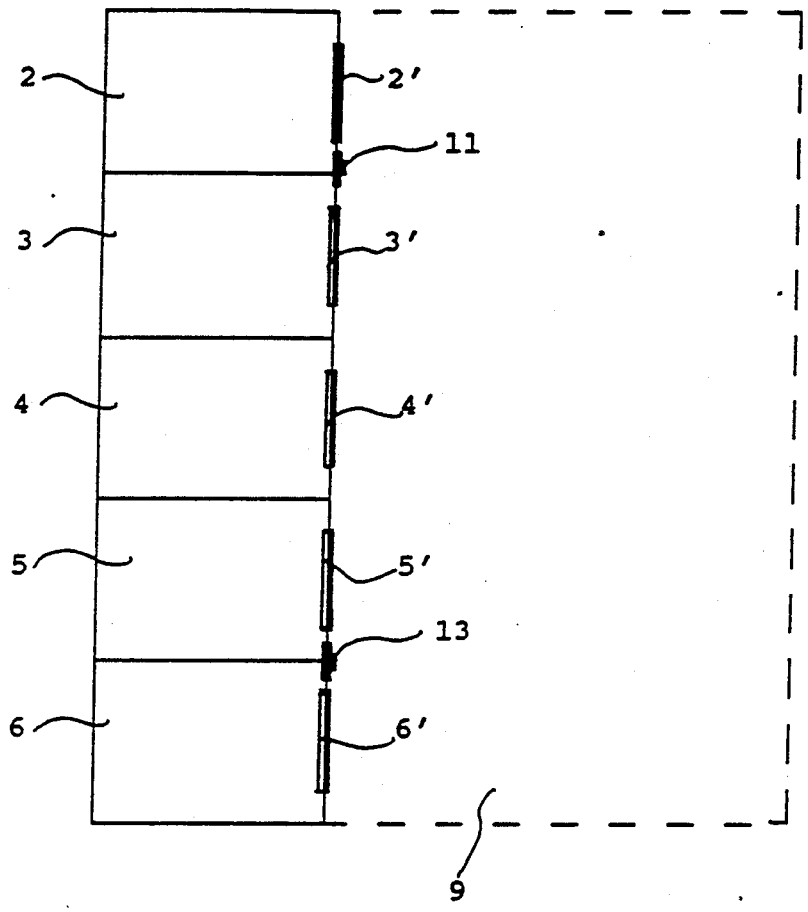
FIGURE 3 (PRIOR ART)
FIG. 3 shows the lay-out for an elevator lobby on the entrance floor according to the commonest rule for a group of five elevators, i.e. all five side by side.

FIG. 3 illustrates the entrance floor elevator lobby 9 in the case of five elevators laid out according to a commonly used rule by which all five elevators are placed on the same side and the call input devices 11 and 13 are laid out in a known manner.

Figure 4:
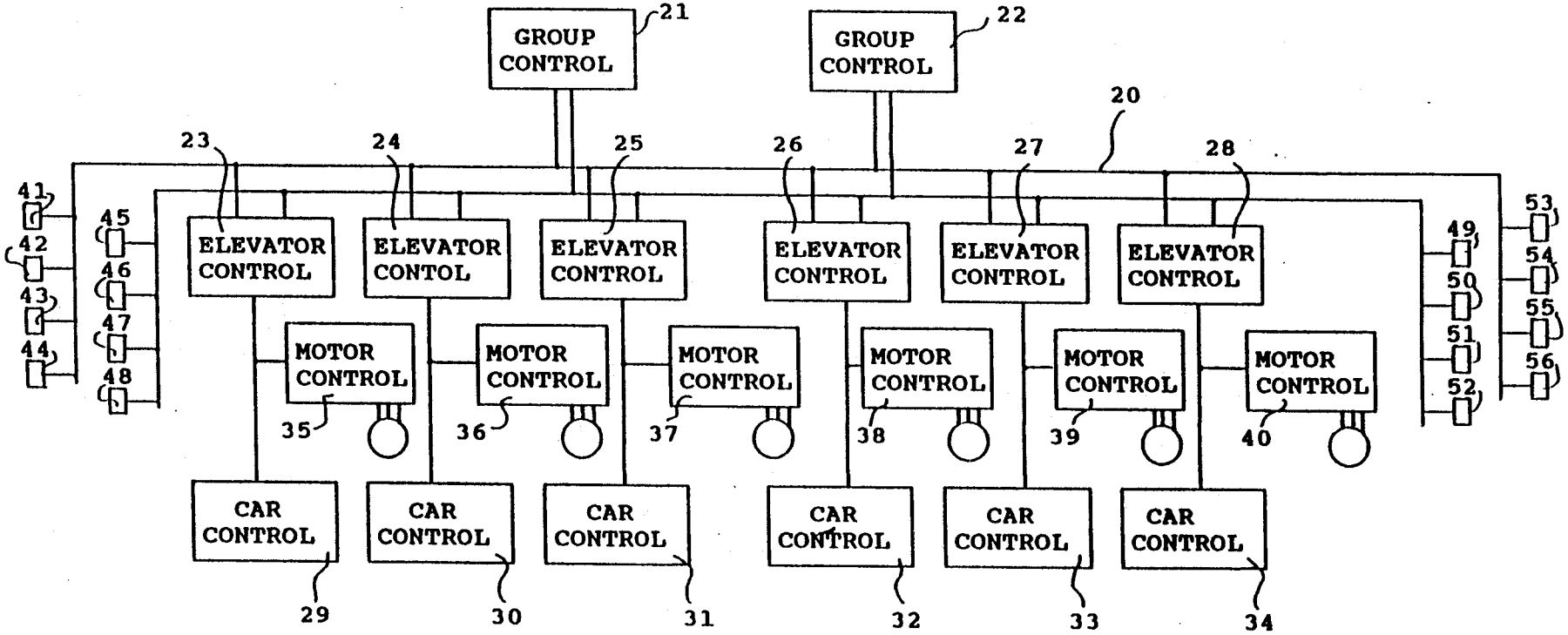
FIG. 4 shows a block diagram representing an elevator group control system of the present invention implemented using a serial communication bus.

FIG. 4 shows a block diagram representing the control system of an elevator group in which the elevators and call input devices are laid out as illustrated in FIG. 2. Connected to a serial communication bus 20 are a main group control computer 21, a stand-by group control computer 22, elevator control units 23–28 for the control and adjustment of the elevators, car control units 29–34 placed in the elevator cars, motor control systems 35–40 and the call input devices for different floors. The call input devices comprise two parallel-connected sets of call buttons 41–56, each set consisting of four pairs of buttons. The group control computer 21 identifies the call input device used for calling an elevator.

Figure 5:
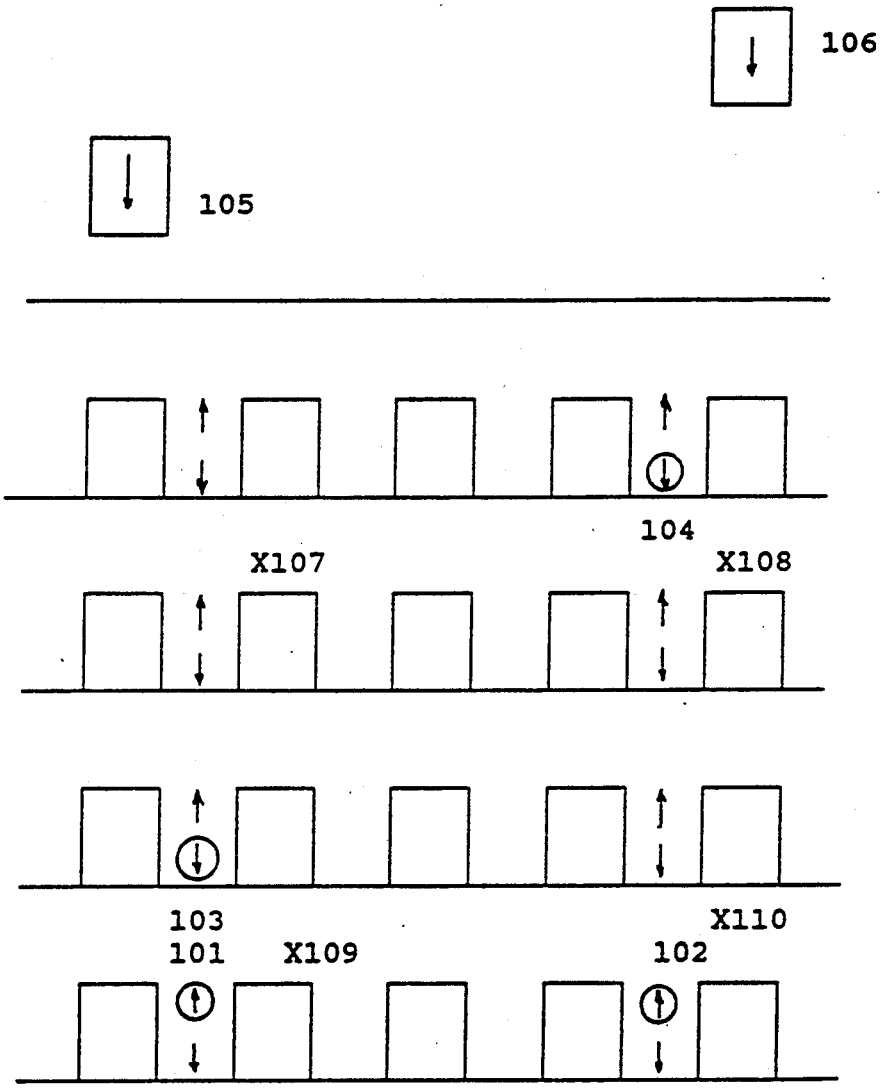
FIG. 5 illustrates a solution to a typical up-peak situation according to the present invention.

FIG. 5 illustrates a typical peak traffic situation in an office building. The present invention is described by use of this exemplary situation. In this figure an up-peak traffic condition is illustrated, in which the prevailing traffic direction is up from the entrance floor, and in which there is some internal traffic within the building. The up-peak is generally the most disadvantageous peak traffic situation, in which the advantages of the present method are also best revealed. It is obvious to a person skilled in the art that the advantages of the invention are more apparent the larger the elevator group is.

In this group of five elevators placed side by side, the following traffic situation is considered as an example. From the entrance floor, up-calls 101 and 102 have been issued, one of which may become active automatically because in the known solutions the calls are connected in parallel, and from the higher floors, two solitary down-calls 103 and 104. The waiting times for these calls at the moment of checking are 15 and 30*s*. If there is nothing extraordinary in the elevator group or the situation (depending on the implementation and the weighting of traffic in the peak direction relative to traffic in the opposite direction), according to the optimization procedure used, the decision to send elevator 105 to serve call 104 and elevator 106 to serve call 103 is made. Consequently, the person who issued the down-call 104 for travelling downwards during the morning up-peak traffic, who is most probably alone standing near the button he has pressed, must walk from point 108 to point 107 when the advance signalling is given. The estimated time needed for covering this distance is generally 5–10 seconds. If the person already has walked to the door of the arriving elevator in time and the door control system works properly, i.e. closes the door almost immediately, the additional time lost due to unnecessary waiting is 0*s*. In practice, some of the passengers do not notice, understand or care about the signalling, which means that they will not start moving until they see the doors opening.

In the present invention, after the group control system has performed the operation described above, an additional optimization is performed, which, while the normal optimization decides to send elevator 105 to serve call 104 in the situation illustrated by the example, discovers that even elevator 106 could be sent to serve call 104 with a quite short additional delay and that calls 103 and 104 are almost equal with respect to promptness of service because the drive time (through two floors) takes only few seconds. Thus, the group control computer sends elevator 106 to serve call 104. This means that when the elevator arrives at the landing, the possibly inattentive passenger will immediately notice the elevator as it comes close.

Correspondingly, elevator 105 is designated to serve call 103. In this case, the passenger at location 109 will have to wait for some time, but on the other hand elevator 106 will not have to wait until the passenger walks from location 109 to location 110. Thus, although the waiting time may be increased in the case of some passengers, the elevators will not wait so long with doors open for the entering passengers. Therefore, the group as a whole has a higher transportation capacity than it has without additional optimization, and so the average waiting times are also shorter. It is also obvious to a person skilled in the art that the parameters for the service of a computer-based control system can be set in accordance with the client's wishes, allowing that the inconveniences suffered by single passengers on behalf of larger number of passengers be counter-balanced according to the situation.

To allow additional optimization, the procedure determines for each call input device the available elevators from which the one to be sent upon a call to the landing in question is selected in the first place. The elevator to be sent is selected among those travelling on the same side of the elevator lobby as where the input device through which the call was issued is located.

The additional optimization can be effected e.g. only if the momentary load of the elevator group or the number of calls waiting to be served exceeds the limit set for a peak traffic condition.

In a large elevator group, if the additional optimization cannot produce an adequate alternative for the selection of the elevator to be sent, then the elevator placed farther away from the call input device is selected, and the door open time for this elevator is prolonged temporarily and the advance signalling announcing its arrival is given earlier than normally.

To guide the passenger in a situation where calls are issued via several call input devices in the lobby, the signal light indicating the registration of a call is lit only for those call input devices through which a call has been issued. The additional optimization is performed on the basis of the oldest call in force.

Figure 6:
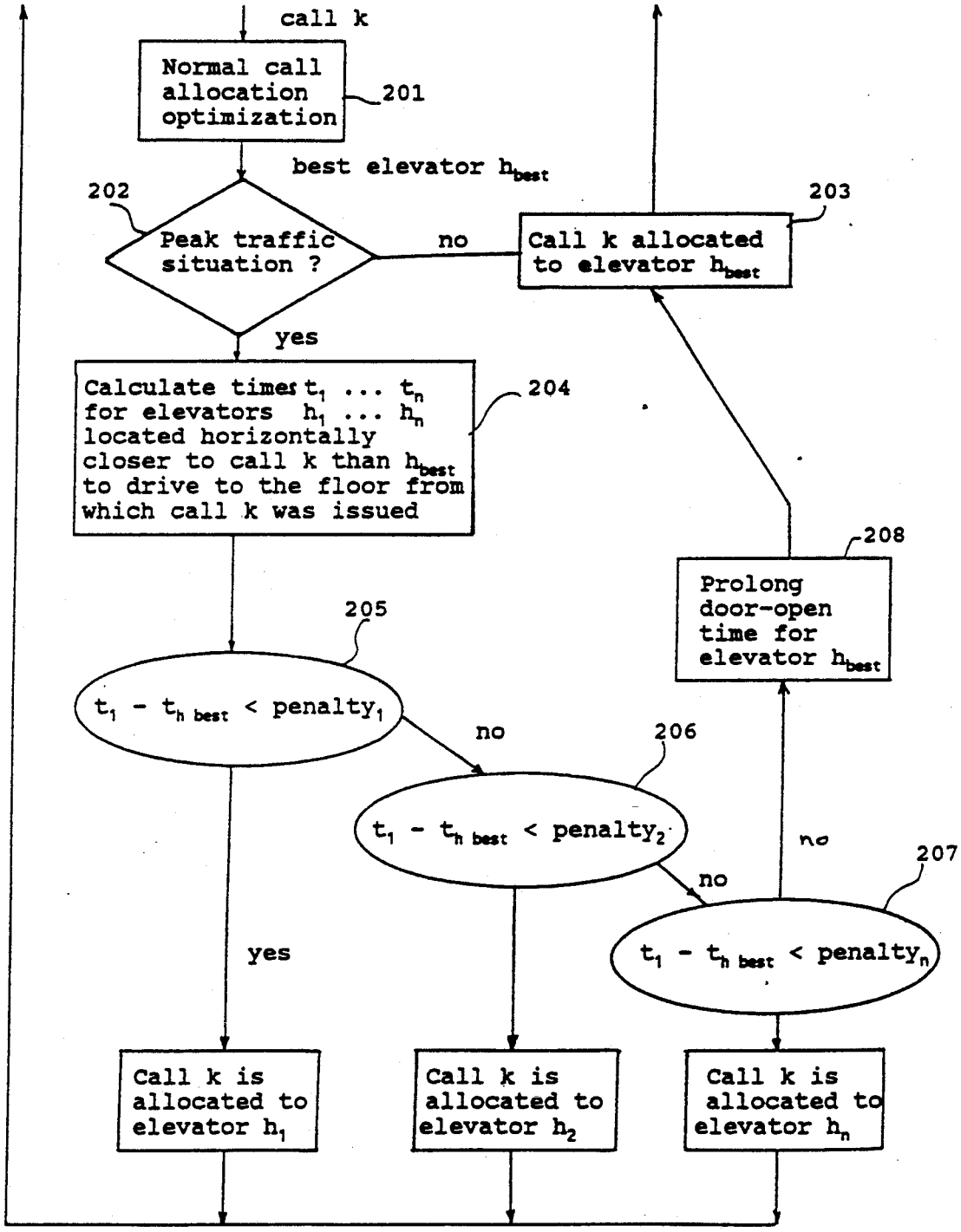
FIG. 6 shows a block diagram representing the allocation of a call issued from a landing according to the present invention.

FIG. 6 shows an example of the allocation of a call issued from landing k. First, the call enters the normal call allocation block 201, where the best suited elevator is selected. Next, the procedure makes a selection between peak traffic and normal traffic condition in block 202. In the case of normal traffic, the call k is allocated to the best elevator in block 203. If a peak traffic condition prevails, then the system calculates in block 204 the drive times t1 . . . tn for those elevators h1 . . . hn which are located horizontally closer to the source of the call k than the "best elevator", h1 standing for the horizontal closest elevator, h2 for the second closest etc. After this, the system selects in blocks 205–207 the elevator to which the call is to be allocated by considering for which elevator the drive time minus the drive time of the "best elevator" is less than the corresponding penalty time, which increases with the elevator's order number based on the horizontal distance. If none of blocks 205–207 is true, then the door-open time for the "best elevator" is prolonged (block 208).

It is obvious to a person skilled in the art that different embodiments of the invention are not restricted to the examples described above, but that they may instead be varied within the scope of the accompanying claims. In addition to peak traffic situations, the procedure of the invention can also be applied during less busy traffic to provide better service to the passengers. For example, if normal optimization would result in the selection of an elevator that is horizontally very far away from the passenger, then the procedure of the invention performs a check to see if another elevator that is horizontally closer to the passenger could be sent to serve the call without an excessive delay.

We claim:

1. A method for selecting an elevator in an elevator group system having a known number of elevators serving a known number of floors of a building and having a group control unit controlling the group, provided with at least one computer, said method comprising the steps of:

(a) providing a floor of said building with a plurality of autonomous call input devices connected to a serial bus;

(b) actuating a call input device and generating a call associated with said actuated call input device;

(c) registering said call in said group control unit and identifying said actuated call input device which has issued said call;

(d) processing said registered call, performing a call allocation optimization, and selecting a particular elevator to serve the floor from where said call was issued, based on the location on said floor of said actuated call input device.

2. A method as claimed in claim 1, wherein step (d) further comprises:

determining a landing distance between said actuated call input device and a door of an elevator of the group associated with said floor, said landing distance indicating the position of a passenger on said floor and using said landing distance in selection of said particular elevator to be sent to serve said call.

3. A method as claimed in claim 2, wherein step (d) includes:

(d1) performing a first call allocation optimization procedure to select a plurality of available elevators to which said call could be allocated; and (d2) subsequently performing an additional call allocation optimization procedure to choose from said plurality of available elevators selected by said first optimization procedure said particular elevator to serve the call on the basis of said landing distance.

4. A method as claimed in claim 1, wherein step (d) comprises selecting said particular elevator from among the available elevators located on the same side of said floor as said actuated call input device.

5. A method as claimed in claim 3, wherein said additional optimization is performed on the basis of the oldest call in force.

6. A method as claimed in claim 1, wherein step (d) further comprises temporarily extending the door-open time for said particular elevator and issuing an advance signalling, indicating its arrival earlier than normal, if the landing distance of said particular elevator is greater than a threshold distance.

7. A method as claimed in claim 1, wherein step (c) comprises marking said actuated call input device which first issued said call, with a visual signal indicating the registration of said call.

8. A method as claimed in claim 1, wherein step (c) comprises marking said actuated all input devices with a visual signal indicating the registration of said call.

9. An elevator group system controlled by a group control unit having a known number of elevators connected via a serial communication bus and serving a known number of floors of a building, comprising:

(a) a plurality of autonomous call input devices connected to said serial communication bus for communicating a call from a passenger and arranged on a floor in a configuration selected according to the building architecture;

(b) elevator, motor and car control means associated with each elevator;

(c) means, responsive in said group control unit, for registering said call and detecting, which of said call input devices was activated by said passenger to issue said call;

(d) means for selecting a particular elevator to serve said issued call according to the location on said floor where said passenger issued said call via said activated call input device; and (e) signalling means for indicating arrival of said particular elevator.

10. An elevator group system as claimed in claim 9, wherein said group control unit determines a landing distance on said floor between said actuated call input device and a door of an elevator, and uses said landing distance in selection of said particular elevator.

11. An elevator group system as claimed in claim 10, wherein said group control unit controls said signalling means to provide advance signalling of elevator arrival and said car control means provides longer door-open times when said landing distance of said particular elevator to said actuated call input device is greater than a threshold distance.

12. An elevator group system as claimed in claim 11, wherein each call input device includes a visual signalling means for indicating registration of a call, said signalling means being activated only for said actuated call input device which issued said call.

13. A method as claimed in claim 2, wherein said particular elevator is selected having the shortest landing distance.

14. A method as claimed in claim 3, wherein said particular elevator is selected having the shortest landing distance.

15. A method as claimed in claim 14, wherein said additional call allocation optimization is performed during periods of peak elevator traffic.

16. A method as claimed in claim 3, wherein said first call optimization procedure selects an optimal elevator from said plurality of available elevators, and wherein said additional call allocation optimization procedure d2 includes:

(1) calculating for those remaining elevators of said plurality of available elevators, which have a shorter landing distance than said optimal elevator, corresponding first drive times to serve the floor from where said call was issued;

(2) calculating a corresponding second drive time for said optimal elevator;

(3) determining drive time differences between each of said first drive times calculated in step (1) and said second drive time calculated in step (2);

(4) comparing each drive time difference determined in step (3) to a corresponding one of a plurality of predetermined penalty values; and (5) selecting one of said remaining elevators as said particular elevator whose corresponding drive time difference is less than its corresponding predetermined penalty value.

17. A method as claimed in claim 10, wherein said particular elevator having the shortest landing distance is selected.

18. A method as claimed in claim 9, wherein said particular elevator is selected among available elevators located on the same side of the elevator lobby as said actuated call input device.

19. A method as claimed in claim 9, said means for selecting further comprising:

means for performing a first call allocation optimization procedure to select a plurality of available elevators to which said call could be allocated, and means for subsequently performing an additional call allocation optimization procedure to choose from said plurality of available elevators selected by said first optimization procedure said particular elevator to serve the call on the basis of said landing distance.

* * * * *